US009035868B2

(12) United States Patent
Yeo et al.

(10) Patent No.: US 9,035,868 B2
(45) Date of Patent: May 19, 2015

(54) METHOD FOR DRIVING A LIGHT SOURCE MODULE AND DISPLAY APPARATUS FOR PERFORMING THE METHOD

(75) Inventors: Dong-Min Yeo, Chungcheongnam-do (KR); Gi-Cherl Kim, Chungcheongnam-do (KR); Yong-Hoon Kwon, Chungcheongnam-do (KR)

(73) Assignee: SAMSUNG DISPLAY CO., LTD. (KR)

( * ) Notice: Subject to any disclaimer, the term of this patent is extended or adjusted under 35 U.S.C. 154(b) by 324 days.

(21) Appl. No.: 12/760,369

(22) Filed: Apr. 14, 2010

(65) Prior Publication Data

US 2010/0277514 A1 Nov. 4, 2010

(30) Foreign Application Priority Data

Apr. 30, 2009 (KR) ..... 10-2009-0037925

(51) Int. Cl.
*G09G 3/36* (2006.01)
*G09G 3/34* (2006.01)

(52) U.S. Cl.
CPC ..... *G09G 3/3426* (2013.01); *G09G 3/3648* (2013.01); *G09G 2320/0633* (2013.01); *G09G 2320/064* (2013.01); *G09G 2320/0646* (2013.01); *G09G 2320/066* (2013.01); *G09G 2360/16* (2013.01)

(58) Field of Classification Search
CPC ..... G09G 3/3406
USPC ..... 345/102
See application file for complete search history.

(56) References Cited

U.S. PATENT DOCUMENTS

| | | | | |
|---|---|---|---|---|
| 7,352,352 | B2 * | 4/2008 | Oh et al. | 345/102 |
| 8,144,108 | B2 * | 3/2012 | Kim | 345/102 |
| 8,319,714 | B2 * | 11/2012 | Kojima et al. | 345/89 |
| 2005/0057484 | A1 * | 3/2005 | Diefenbaugh et al. | 345/102 |
| 2006/0238485 | A1 * | 10/2006 | Yang | 345/102 |
| 2007/0040783 | A1 * | 2/2007 | Kawada et al. | 345/88 |
| 2007/0097045 | A1 | 5/2007 | Lee et al. | |
| 2007/0152926 | A1 * | 7/2007 | Kwon | 345/82 |
| 2007/0152954 | A1 | 7/2007 | Daly | |
| 2008/0266240 | A1 * | 10/2008 | Chen et al. | 345/102 |

(Continued)

FOREIGN PATENT DOCUMENTS

| | | |
|---|---|---|
| CN | 1794340 | 6/2006 |
| CN | 101399023 | 4/2009 |

(Continued)

OTHER PUBLICATIONS

European Search Report corresponding to EP10004027.8, Nov. 19, 2010, 7 pages.

(Continued)

*Primary Examiner* — Roy Rabindranath
(74) *Attorney, Agent, or Firm* — Innovation Counsel LLP

(57) ABSTRACT

A method for driving a light source module, the light source module including a plurality of light-emitting blocks, a driving mode of the light-emitting block providing light to a plurality of pixels displaying a unit image is determined by analyzing grayscale values corresponding to the pixels. A second driving signal is applied to the light-emitting block determined to be in a boosting mode, the second driving signal having a level higher than the level of a first driving signal applied to the light-emitting block determined to be in a normal mode.

14 Claims, 10 Drawing Sheets

(56) References Cited

U.S. PATENT DOCUMENTS

| | | | | |
|---|---|---|---|---|
| 2009/0079768 | A1* | 3/2009 | Huang | 345/691 |
| 2009/0295841 | A1* | 12/2009 | Park et al. | 345/690 |
| 2010/0231573 | A1* | 9/2010 | Adachi | 345/211 |

FOREIGN PATENT DOCUMENTS

| | | |
|---|---|---|
| JP | 2007-187974 | 7/2007 |
| JP | 2008-263586 | 10/2008 |
| KR | 10-2009-0007027 A | 1/2009 |

OTHER PUBLICATIONS

Pierre De Greef, et al., "39.1 Adaptive Dimming and Boosting Backlight for LCD-TV Systems", NXP Semiconductors (founded by Philips), Innovation Center—Display Solutions, Eindhoven, the Netherlands, 200705-20, pp. 1332-1335, vol. XXXVIII.

* cited by examiner

<SECOND DRIVING SIGNAL OF THE BOOSTING MODE>

<FIRST DRIVING SIGNAL OF THE NORMAL MODE>

<SECOND DRIVING SIGNAL OF THE BOOSTING MODE>

<FIRST DRIVING SIGNAL OF THE NORMAL MODE>

METHOD FOR DRIVING A LIGHT SOURCE MODULE AND DISPLAY APPARATUS FOR PERFORMING THE METHOD

PRIORITY STATEMENT

This application claims priority under 35 U.S.C. §119 to Korean Patent Application No. 2009-37925, filed on Apr. 30, 2009 in the Korean Intellectual Property Office (KIPO), the contents of which are herein incorporated by reference in their entirety.

BACKGROUND OF THE INVENTION

1. Field of the Invention

Example embodiments of the present invention relate to a method for driving a light source module, and a display apparatus for performing the method. More particularly, example embodiments of the present invention relate to a method for driving a light source module capable of improving display quality, and a display apparatus for performing the method.

2. Description of the Related Art

Generally, a liquid crystal display (LCD) apparatus includes an LCD panel displaying an image using the optical transmittance of liquid crystal molecules and a backlight assembly disposed below the LCD panel to provide the LCD panel with light. The LCD panel includes an array substrate, a color filter substrate and a liquid crystal layer. The array substrate includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate.

When an electric field generated between the pixel electrode and the common electrode is applied to the liquid crystal layer, the arrangement of liquid crystal molecules of the liquid crystal layer is changed to control the optical transmissivity of the liquid crystal layer, so that the image is displayed. The LCD panel displays a white image of a high luminance when the optical transmissivity is increased to the maximum, and the LCD panel displays a black image of a low luminance when the optical transmissivity is decreased to the minimum.

However, the LCD apparatus may produce more glare than other types of display apparatuses, such as cathode ray tube (CRT) and plasma display panel (PDP) display devices. The LCD apparatus displays the image using the backlight assembly to generate light, so that the luminance distribution of the LCD apparatus may be different from the luminance distribution of the CRT or PDP display devices. Therefore, the LCD apparatus may increase a user's eye strain.

Recently, in order to increase the contrast ratio of the image and to decrease power consumption, a method for local dimming of a light source has been developed, in which the light sources are driven in such a way as to individually control the amount of light according to positions of light sources. In the method for local dimming of the light source, the light source is divided into a plurality of light-emitting blocks, and the amount of light emitted by the light-emitting blocks is controlled to correspond with dark and bright areas of a display area of the LCD panel.

SUMMARY OF THE INVENTION

Example embodiments of the present invention provide a method for driving a light source module capable of improving display quality.

Example embodiments of the present invention also provide a display apparatus for performing the method.

According to one aspect of the present invention, a method for driving a light source module is provided. The light source module includes a plurality of light-emitting blocks that provide light to a plurality of pixels that display a unit image. A driving mode for each such light-emitting block is determined by analyzing grayscale values corresponding to the pixels. If the driving mode of a light emitting block is determined to be in a boosting mode, a second driving signal is applied to the light-emitting block, the second driving signal having a level higher than the level of a first driving signal applied to the light-emitting block determined to be in a normal mode.

According to one aspect of the present invention, a display apparatus includes a light source module and a driving part. The light source module emits light, and includes a plurality of light-emitting blocks, the light-emitting blocks providing light to a plurality of pixels displaying a unit image. The driving part determines a driving mode of such a light-emitting block by analyzing grayscale values respectively corresponding to the pixels. If the driving part determines the driving mode of a light emitting block is in a boosting mode, the driving part applies a second driving signal to the light-emitting block. Such a second driving signal having a level higher than the level of a first driving signal which was applied to the light-emitting block having a driving mode determined to be in a normal mode.

According to the present invention, the level of a driving signal is increased when the size of a bright image included in a unit image is decreased. Therefore, the luminance value of the unit image may be defined by a bright image size to the power of a luminance characteristics parameter H in a sensitivity display area.

BRIEF DESCRIPTION OF THE DRAWINGS

The above and other features and advantages of the present invention will become more apparent by describing in detail example embodiments thereof with reference to the accompanying drawings, in which.

DETAILED DESCRIPTION OF THE INVENTION

Figure 1:
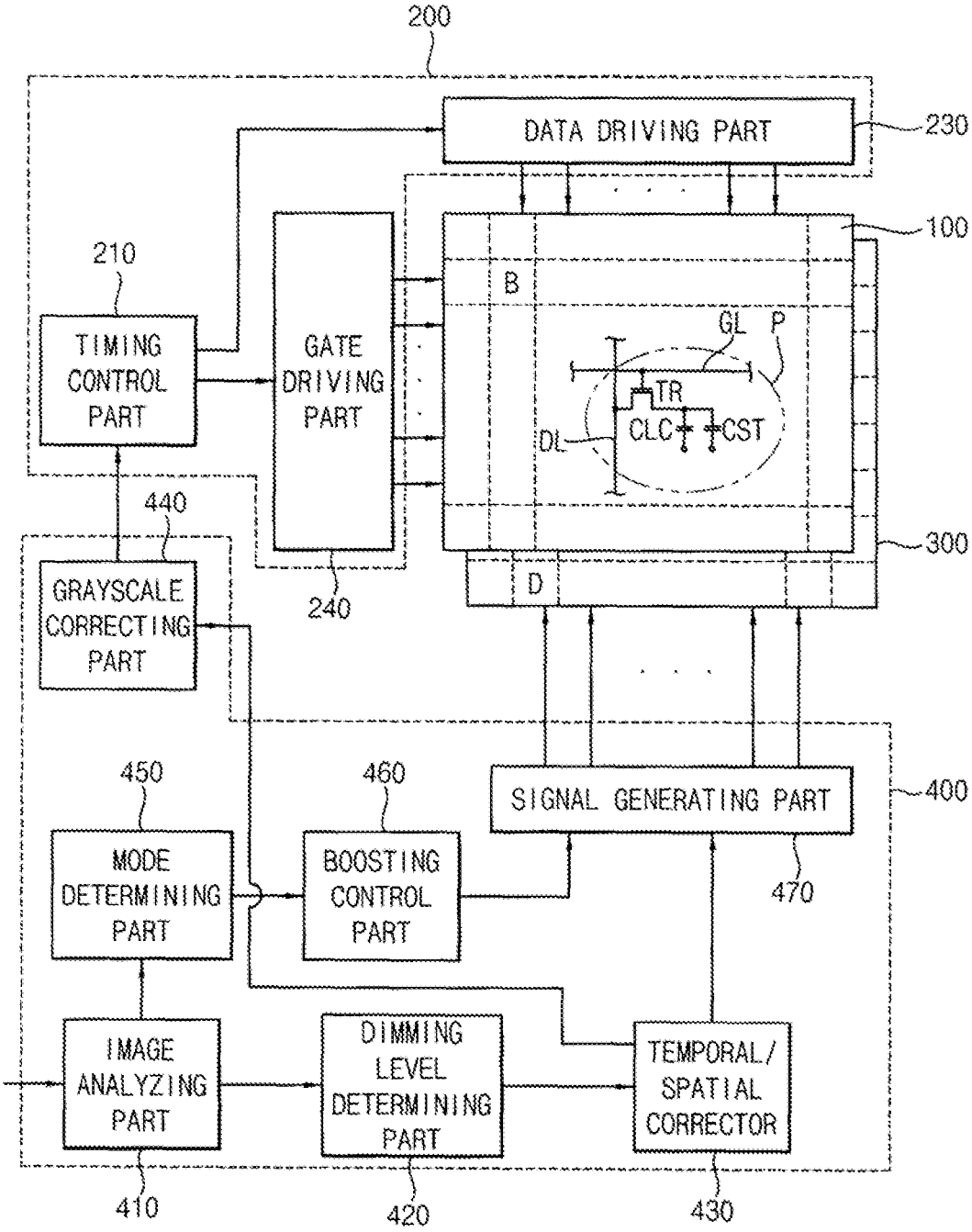
FIG. 1 is a block diagram illustrating a display apparatus according to an example embodiment of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below depending on the orientation of the device. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram illustrating a display apparatus according to an example embodiment of the present invention.

Referring to FIG. 1, the display apparatus includes a display panel 100, a panel driving part 200, a light source module 300 and a driving part 400.

The display panel 100 includes a plurality of pixels, for example, M×N pixels (M and N are natural numbers). Each pixel P includes a switching element TR connected to a gate line GL and a data line DL, a liquid crystal capacitor CLC connected to the switching element TR and a storage capacitor CST connected to the liquid crystal capacitor CLC.

The panel driving part 200 includes a timing control part 210, a data driving part 230 and a gate driving part 240.

The timing control part 210 receives pixel data. Each of the pixel data is a digital grayscale value. The timing control part 210 generates a timing control signal for controlling a driving timing of the display panel 100. The timing control signal includes a clock signal, a horizontal starting signal and a vertical starting signal.

The data driving part 230 drives the data line DL of the display panel 100 using the timing control signal and a corrected grayscale.

The gate driving part 240 drives the gate line GL of the display panel 100 using the timing control signal, a gate-on voltage and a gate-off voltage.

The light source module 300 includes a printed circuit board (PCB) having a plurality of light-emitting diodes (LEDs) disposed thereon. The LEDs may include a red LED, a green LED, blue LED and a white LED. The light source module 300 comprises m×n light-emitting blocks B. Each individual light-emitting block B includes a plurality of LEDs.

The driving part 400 includes an image analyzing part 410, a dimming level determining part 420, a temporal/spatial correcting part 430, a grayscale correcting part 440, a mode determining part 450, a boosting control part 460 and a signal generating part 470.

The image analyzing part 410 divides the pixel data into a plurality of image blocks D respectively corresponding to the light-emitting blocks B, and analyzes the pixel data. For example, the image analyzing part 410 obtains a plurality of representative grayscale values respectively corresponding to the image blocks D. Each of the representative grayscale values may be an average grayscale value, a maximum grayscale value, or a selected grayscale value between a maximum grayscale value and a minimum grayscale value. The representative grayscale value may be determined by various formulas.

The dimming level determining part 420 determines a plurality of dimming levels for each of the corresponding light-emitting blocks B based on the representative grayscale values outputted from the image analyzing part 410. Each of the dimming levels controls the luminance of each of the light-emitting blocks B. For example, the dimming level may be determined based upon a duty ratio level of a pulse width modulation (PWM) signal.

The temporal/spatial correcting part 430 includes a temporal low-pass-filter (LPF) and a spatial LPF, and corrects the dimming levels to smooth out the temporal and spatial profiles of the dimming levels. For example, the spatial LPF may correct a dimming level of a predetermined light-emitting block so that its dimming level is set to the lowest dimming level among the dimming levels determined between the predetermined light-emitting block and peripheral light-emitting blocks located around the predetermined light-emitting block. The temporal LPF corrects a dimming level of a predetermined light-emitting block so that its dimming level is set to the lowest dimming level between the dimming levels of present frame (for example, n-th frame) and previous frame (for example, (n-1)-th frame) (n is a natural number). Therefore, temporal and spatial profiles of the corrected dimming levels may be smooth.

The grayscale correcting part 440 corrects the grayscales based on the dimming levels outputted from the dimming level determining part 420. Thus, the transmittance of light transmitted from the pixel of the display panel 100 may be controlled using the corrected grayscale. Therefore, the transmittance of the display panel 100 is controlled according to luminance of the light-emitting blocks B, which are individually driven, so that power consumption may be reduced and a contrast ratio may be improved.

The mode determining part 450 determines a driving mode of a light-emitting block corresponding to a unit image by comparing a reference value with each of the grayscales corresponding to the unit image. The grayscales corresponding to the unit image are outputted from the image analyzing part 410 or, alternatively, are received from the exterior of the driving part 400. The unit image may be an image corresponding to a single light-emitting block, an image corresponding to a plurality of light-emitting blocks, or a frame image corresponding to all light-emitting blocks of the light source module 300.

For example, the grayscales corresponding to the unit image may include a low grayscale that is lower than a low reference value and a high grayscale that is higher than a high reference value. When a ratio of the low grayscale and the high grayscale satisfies a boosting condition, the light-emitting block corresponding to the unit image is determined to be in a boosting mode. However, when the ratio of the low grayscale and the high grayscale does not satisfy the boosting condition, the light-emitting block corresponding to the unit image is determined to be in a normal mode. For example, the ratio used to satisfy the boosting condition may be variously set to values such as (5:1), (10:1), (50:1) or (100:1), etc. Generally, the low grayscale corresponds to a background image and the high grayscale corresponds to a bright image. When the grayscale value is an 8-bit value, the low reference value may be a grayscale value from about 0 to about 30 and the high reference value may be a grayscale value from about 240 to about 255. The low and high reference values may be variously set.

The boosting control part 460 controls levels of a plurality of driving signals respectively corresponding to the light-emitting blocks B according to the driving mode determined from the mode determining part 450. Each of the levels is a peak current level of the driving signal. For example, for a light-emitting block determined to be in the normal mode, the boosting control part 460 sets a peak current level of the driving signal to a normal current level and, likewise, for a light-emitting block that is determined to be in the boosting mode, the boosting control part 460 sets a peak current level of the driving signal to a boosting current level.

The signal generating part 470 generates the driving signals for the light-emitting blocks B and applies the driving signals to the light-emitting blocks B. The driving signals have duty ratios based on the dimming levels outputted from the dimming level determining part 420, respectively and have peak currents based on the peak current levels outputted from the boosting control part 460, respectively. The light-emitting block determined to be in the normal mode receives a first driving signal corresponding to the normal current level and the light-emitting block determined to be in the boosting mode receives a second driving signal corresponding to the boosting current level. The first and second driving signals may have the same maximum duty ratio, when the light-emitting blocks emit full-white light.

Figure 2A:
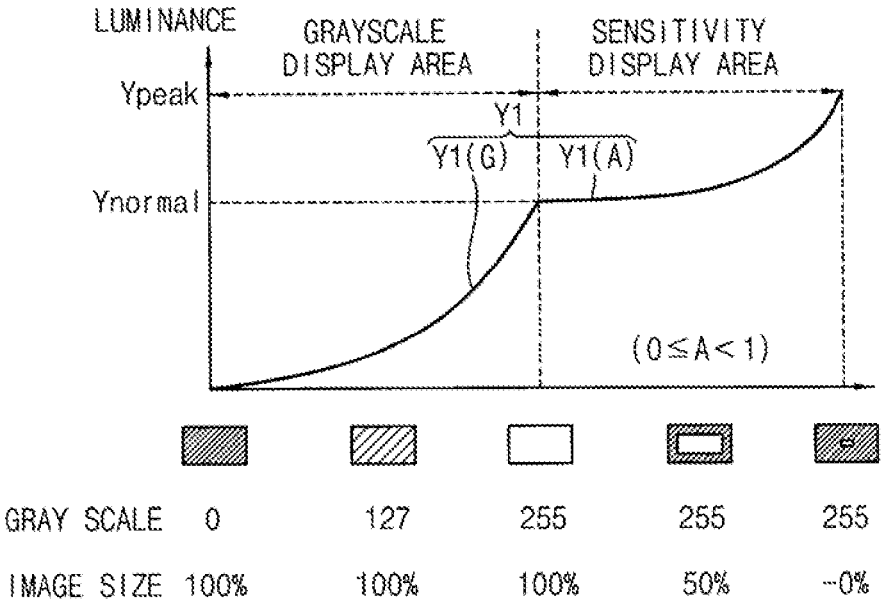
FIGS. 2A, 2B and 2C are graphs showing various luminance curves according to the display apparatus of FIG. 1.
Figure 2B:
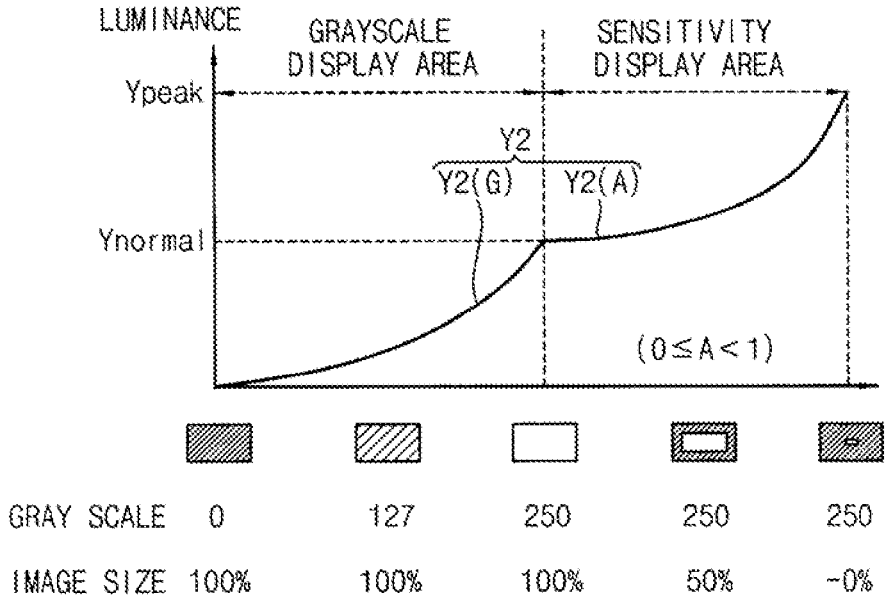
Figure 2C:
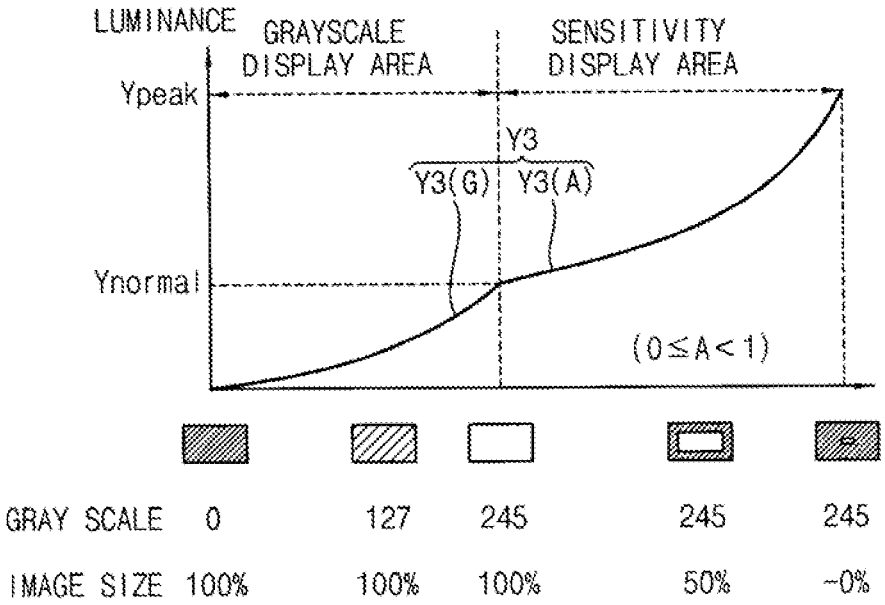
Figure 3:
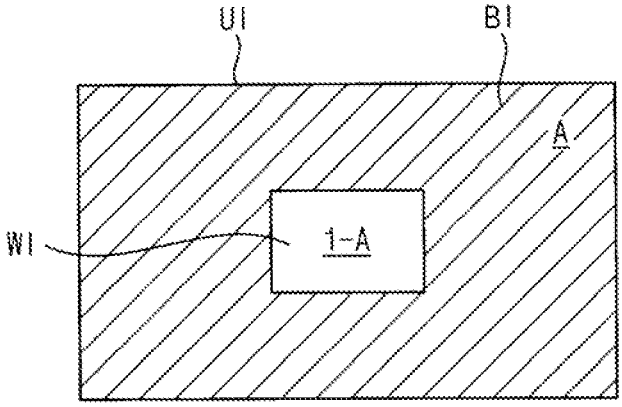
FIG. 3 is a schematic diagrams illustrating luminance characteristics of the sensitivity display area of FIGS. 2A to 2C.

FIGS. 2A, 2B and 2C are graphs showing various luminance curves according to the display apparatus of FIG. 1. FIG. 3 is a schematic diagrams illustrating a luminance character of the sensitivity display area of FIGS. 2A to 2C;

Referring to FIGS. 2A and 3, the display apparatus drives to the boosting mode when the grayscale value is "255" (based on 8 bits). That is, "255" may be the high reference value of the boosting condition. In this case, a display area of the display apparatus may be divided into a grayscale display area and a sensitivity display area with respect to "255. The display apparatus has a first luminance curve (Y1) including a first curve (Y1(G)) corresponding to the grayscale display area and a second curve (Y1(A)) corresponding to the sensitivity display area.

According to the first curve (Y1(G)) of the grayscale display area, a luminance value may be defined by a fraction according to a grayscale value from about 0 to about 255 to the power of a gamma (γ) value. When the grayscale value is increased, the luminance value is increased. Thus, when the light source module 300 is driven in a full-white state, the luminance value is a normal luminance (Ynormal). The first curve (Y1(G)) of the grayscale display area may be defined by the following Equation 1.

$$Y1(G) = Y_{normal} \times \left(\frac{G}{255}\right)^{\gamma=2.2} \quad \text{Equation 1}$$

The normal luminance value (Ynormal) is a luminance value of the light source module 300 when the light source module 300 is driven in a full-white state.

According to the second curve (Y1(A)), a luminance value is defined by the size of a bright image having the grayscale value "255." As shown in FIG. 2A, when the size of the bright image having the grayscale value "255" is decreased from 100% to 0%, the luminance value is increased from the normal luminance value (Ynormal) to a maximum luminance value (Ypeak).

For example, as shown in FIG. 3, the size of a unit image (UI) is "1," the size of a background image having a black grayscale value "0" is "A" and the size of a bright image (WI) having the grayscale value "255" is "1-A." A is defined by $0 \leq A < 1$. When the size of the bright image (WI) is decreased from 100% to 0%, the luminance value is increased from the normal luminance value (Ynormal) to the maximum luminance value (Ypeak). Thus, when the size of the bright image (WI) is at the minimum, the luminance value is at the maximum luminance value (Ypeak). The second curve (Y1(A)) of the sensitivity display area may be defined by the following Equation 2.

$$Y1(A)=Y_{normal}\times(1-A^H)+Y_{peak}\times A^H \qquad \text{Equation 2}$$

The maximum luminance value (Ypeak) is selected by a user, and H is a luminance character parameter which is set by the user.

According to the second curve (Y1(A)) of the grayscale display area, the luminance value may be defined by the bright image size (1-A) to the power of H.

Referring to FIGS. 2B and 3, the display apparatus drives to the boosting mode when the grayscale value is "250" (based on 8 bits). That is, "250" is the high reference of the boosting condition. In this case, a display area of the display apparatus may be divided into a grayscale display area and a sensitivity display area with respect to the 250 grayscale. The display apparatus has a second luminance curve (Y2) including a first curve (Y2(G)) corresponding to the grayscale display area and a second curve (Y2(A)) corresponding to the sensitivity display area.

According to the first curve (Y2(G)) of the grayscale display area, a luminance value may be defined by a fraction according to a grayscale value from about 0 to about 250 to the power of a gamma value as in Equation 1. According to the second curve (Y2(A)) of the grayscale display area, the luminance value is defined by the bright image size (1-A) to the power of H as in Equation 2, wherein the bright image has the grayscale value that is greater than the grayscale value "250."

Referring to FIGS. 2C and 3, the display apparatus drives to the boosting mode when the grayscale value is "245" (based on 8 bits). That is, "245" is the high reference of the boosting condition. In this case, a display area of the display apparatus may be divided into a grayscale display area and a sensitivity display area with respect to the 245 grayscale. The display apparatus has a third luminance curve (Y3) including a first curve (Y3(G)) corresponding to the grayscale display area and a second curve (Y3(A)) corresponding to the sensitivity display area.

According to the first curve (Y3(G)) of the grayscale display area, a luminance value may be defined by a fraction according to a grayscale value from about 0 to about 245 to the power of a gamma value as in Equation 1. According to the second curve (Y3(A)) of the grayscale display area, the luminance value may be defined by the bright image size (1-A) to the power of H as in Equation 2, wherein the bright image has the grayscale value that is greater than the grayscale value 245.

As described above, the display area may be varied according to the boosting condition. The display area may be divided into the grayscale display area and the sensitivity display area with respect to the high reference value of the boosting condition. Additionally, in the sensitivity display area, the luminance value may be defined by the bright image size to the power of H.

Figure 4:
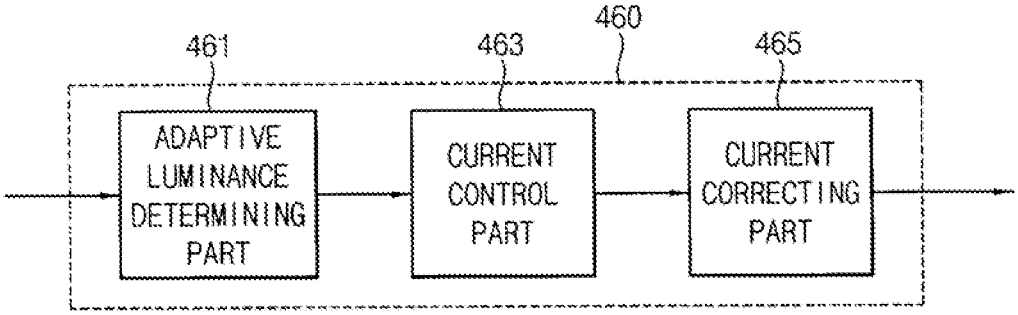
FIG. 4 is a block diagram illustrating the boosting control part of FIG. 1.

FIG. 4 is a block diagram illustrating the boosting control part 460 of FIG. 1;

Referring to FIGS. 1 to 4, the boosting control part 460 includes an adaptive luminance determining part 461, a current control part 463 and a current correcting part 465.

The adaptive luminance determining part 461 determines an adaptive luminance value (Y(Δ)) of a unit image when the grayscale values corresponding to that unit image satisfy the boosting condition. For example, the adaptive luminance determining part 461 may determine the adaptive luminance value (Y(Δ)) of the unit image using a maximum grayscale value, a minimum grayscale value and an average grayscale value corresponding to the unit image.

Hereinafter, referring to FIG. 3 and Equation 2, a method of calculating the adaptive luminance value (Y(Δ)) will be explained.

A substitution factor corresponding to the size (A) of the background image (BI) may be calculated using the grayscale values of the unit image (UI). The maximum grayscale value (GMax), the average grayscale value (GAvg) and the substitution factor (Δ) of the unit image (UI) may be calculated using the following Equation 3.

$$G_{Max}=G_I,\ G_{Min}=G_B$$

$$G_{Aug}=G_B\times A+G_{max}\times(1-A)$$

$$G_{Max}-G_{Aug}=(G_{Max}-G_{Min})\times A \qquad \text{Equation 3}$$

Referring to Equation 3, the maximum grayscale value (GMax) is substantially the same as a white grayscale value (GI) corresponding to a white image and the minimum grayscale value (GMin) is substantially the same as a black grayscale value (GB) corresponding to a black image, that is the background image. Referring to Equation 3, the substitution factor (Δ), which is substituted for the size (A) of the black image, may be defined by the following Equation 4.

$$\Delta=G_{Max}-G_{Aug}=(G_{Max}-G_{Min})\times A \qquad \text{Equation 4}$$

Referring to Equations 2 and 4, the adaptive luminance value (Y(Δ)) may be defined by the following Equation 5.

$$Y(\Delta)=Y_{normal}+(Y_{peak}-Y_{normal})\times\left(\frac{\Delta}{G_{max}-G_{min}}\right)^H \qquad \text{Equation 5}$$

Ynormal, Ypeak and H are the set values. The substitution factor (Δ) is a difference value between the maximum grayscale value (GMax) and the average grayscale value (GAvg), the white grayscale value (GI) is substantially the same as the maximum grayscale value (GMax) and the black grayscale value (GB) is substantially the same as the minimum grayscale value (GMin).

Therefore, the adaptive luminance determining part 461 may determine the adaptive luminance value (Y(Δ)) of the unit image through Equation 5, based on the maximum grayscale value (GMax), the minimum grayscale value (GMin) and the average grayscale value (GAvg).

The current control part 463 calculates the boosting current level (Iboost) based on the adaptive luminance value (Y(Δ)). The boosting current level (Iboost) may be calculated using the following Equation 6.

$$Y_{normal}:\ I_{normal}=Y(\Delta):\ I_{boost} \qquad \text{Equation 6}$$

$$I_{boost}=I_{normal}\times\left[1-\left(1-\frac{Y_{peak}}{Y_{normal}}\right)\times\left(\frac{\Delta}{G_{max}-G_{min}}\right)^H\right]$$

The normal current level (Inormal) is substantially the same as a peak current level of the driving signal for driving the light-emitting block B in the full-white state.

The boosting current level (Iboost) is increased when the size of the bright image is decreased. Thus, as the second curves (Y1(A)), (Y2(A)) and (Y3(A)) shown in FIGS. 2A to 2C, the luminance value may be defined by the bright image size to the power of H.

The current control part 463 controls the current level of the driving signal used for driving the light-emitting block to the boosting current level (Iboost) when the light-emitting block is in the boosting mode. Additionally, the current control part 463 controls the current level of the driving signal used for driving the light-emitting block to the normal current level (Inormal) when the light-emitting block is in the normal mode.

The current correcting part 465 corrects the current level so that the current level of the driving signal has smooth temporal and spatial profiles.

For example, when the driving mode is determined using the unit image corresponding to a single light-emitting block or grouped light-emitting blocks, the current correcting part 465 corrects the current levels corresponding to a light-emitting block in the boosting mode and also peripheral light-emitting blocks located around the light-emitting block having the boosting mode, so that a spatial profile of the current levels is smooth. Additionally, the current correcting part 465 corrects the current levels corresponding to present and previous frames, so that a temporal profile of the current levels is smooth.

However, when the driving mode is determined using the frame image corresponding to all light-emitting blocks of the light source module 300, the current correcting part 465 may not spatially correct the current levels of all light-emitting blocks. When all light-emitting blocks are determined to be in the boosting mode, the current levels of all light-emitting blocks are determined to be at the boosting current levels. Thus, the current correcting part 465 does not spatially correct the current levels. However, the current correcting part 465 does temporally correct the current levels when the driving mode is determined using the frame image corresponding to all light-emitting blocks of the light source module 300, so that the current levels may have the temporal smoothing profile.

Figure 5:
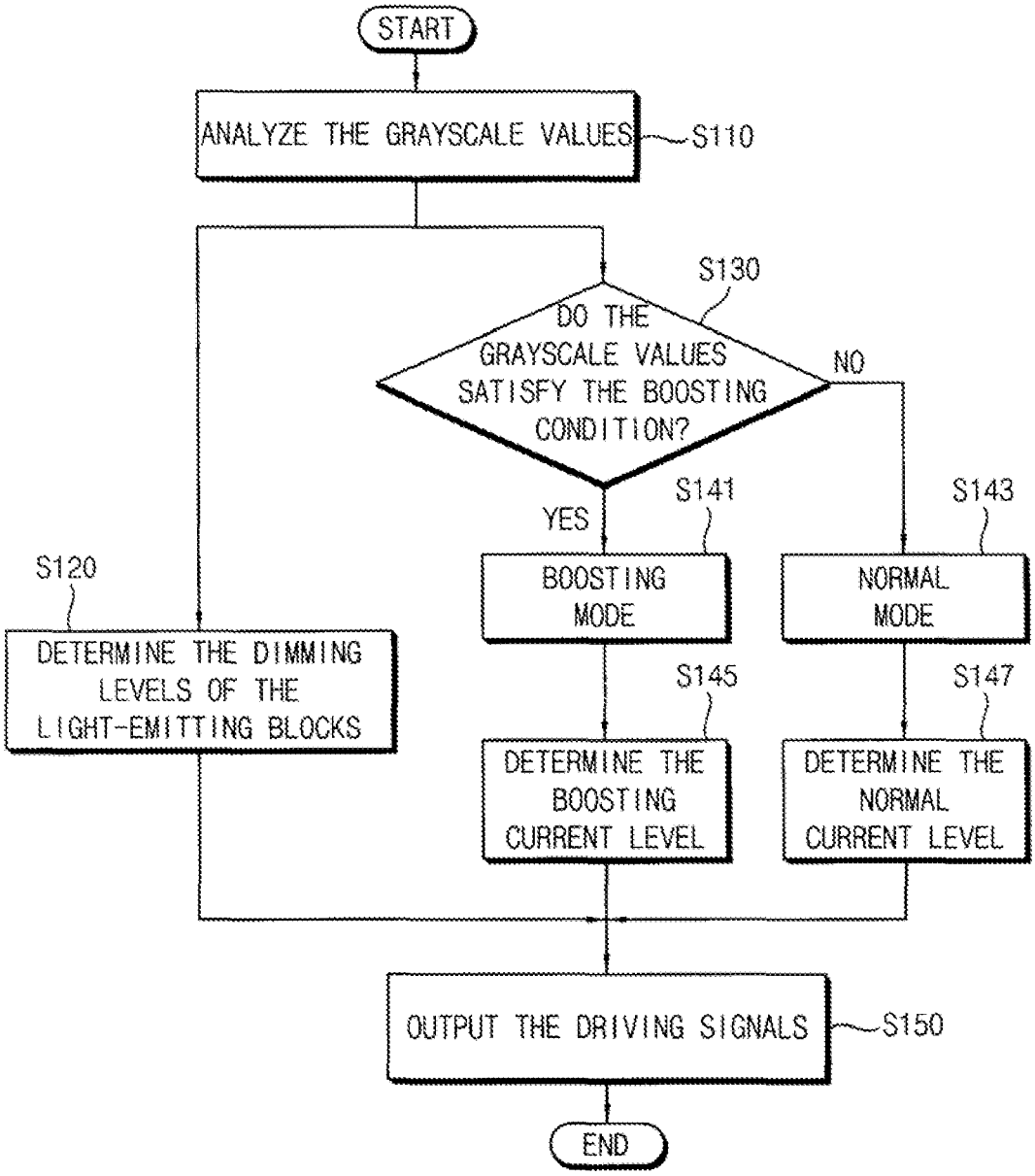
FIG. 5 is a flowchart illustrating a method for driving the driving part of FIG. 1.
Figure 6:
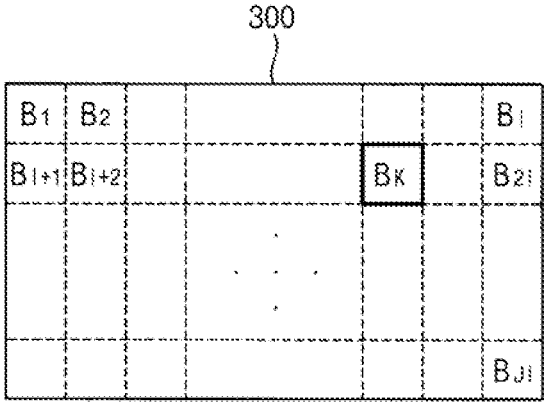
FIG. 6 is a plan view illustrating the light source module of FIG. 1.
Figure 7A:
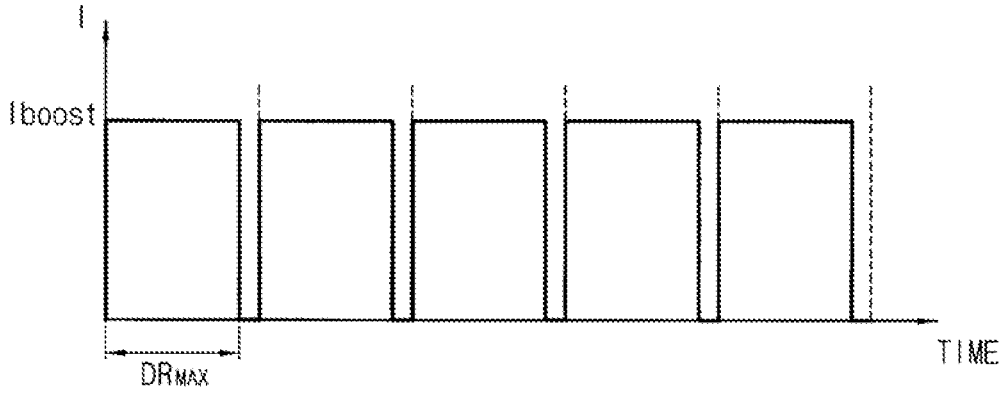
FIGS. 7A and 7B are waveform diagrams showing the driving signals of a boosting mode and a normal mode according to a driving method of FIG. 5.
Figure 7B:
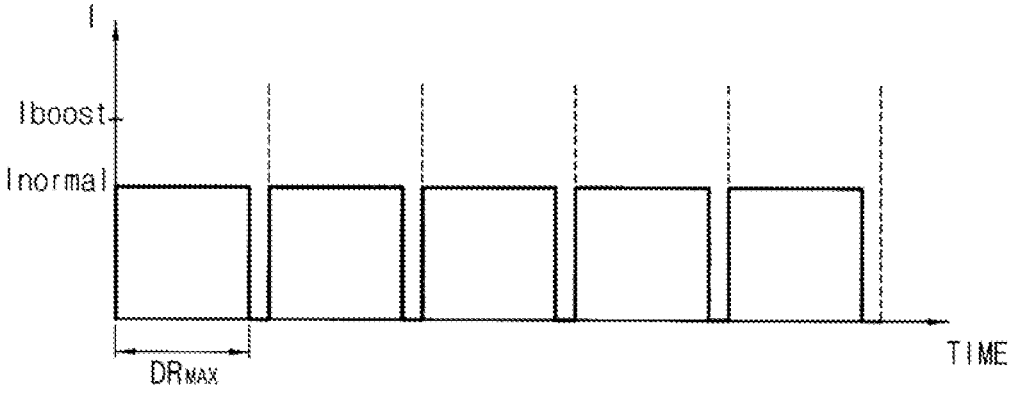

FIG. 5 is a flowchart illustrating a method for driving the driving part of FIG. 1. FIG. 6 is a plan view illustrating the light source module of FIG. 1. FIGS. 7A and 7B are waveform diagrams showing the driving signals of a boosting mode and a normal mode, respectively, according to the method for driving of FIG. 5;

Referring to FIGS. 1 and 5, the image analyzing part 410 divides the pixel data into a plurality of image blocks D respectively corresponding to the light-emitting blocks B and analyzes the grayscale values respectively corresponding to the image blocks D (step S110).

The dimming level determining part 420 determines the dimming levels of the light-emitting blocks B based on the representative grayscale values of the image blocks D outputted from the image analyzing part 210 (step S120). The dimming levels may be corrected by the temporal/spatial correcting part 430 to have the temporal and spatial smoothing profiles.

The mode determining part 450 uses the grayscale values of the unit image to determine whether the light-emitting block corresponding to the unit image satisfies the boosting condition (step S130).

Referring to FIG. 6, the light source module 300 includes a plurality of light-emitting blocks B1, . . . , BJI having a two-dimensional (2D) structure. The light source module 300 may alternatively include a plurality of light-emitting blocks having a one-dimensional (1D) structure. The mode determining part 450 uses the grayscale values of the unit image to determine the driving mode of the light-emitting block corresponding to the unit image. The unit image may be set such that the image corresponds to the single light-emitting block (for example, B1), to grouped light-emitting blocks (for example, B1, B2, BI+1, BI+2), or to the frame image corresponding to all light-emitting blocks (for example, B1, . . . , BJI) of the light source module 300.

When the ratio of the low grayscale value and the high grayscale value satisfies a boosting condition, the mode determining part 450 determines the driving mode of the light-emitting block corresponding to the unit image to be the boosting mode (step S141). For example, the ratio used to satisfy the boosting condition may be variously set to values such as (5:1), (10:1), (50:1), (100:1), etc. Therefore, the luminance value of the light-emitting block may be substantially the same as the luminance value corresponding to the second (Y1(A), Y2(A) or Y3(A)) of the sensitivity display area shown in FIGS. 2A, 2B and 2C having the luminance value changed according to the size of the bright image included in the unit image.

However, when the ratio of the low grayscale value and the high grayscale value does not satisfy the boosting condition, the mode determining part 450 determines the driving mode of the light-emitting block corresponding to the unit image to be the normal mode (step S143). Therefore, the luminance value of the light-emitting block may be substantially the same as the luminance value corresponding to the first (Y1(G), Y2(G) or Y3(G)) of the grayscale display area shown in FIGS. 2A, 2B and 2C having the luminance value changed according to the grayscale value.

For example, when a K-th light-emitting block BK satisfies the boosting condition and the remaining light-emitting blocks B1, B2, . . . , BJI do not satisfy the boosting condition, the mode determining part 450 will determine the driving mode of the K-th light-emitting block BK to be the boosting mode and the driving modes of the remaining light-emitting blocks B1, B2, . . . , BJI are the normal mode.

The boosting control part 460 determines the peak current level according to the driving mode determined from the mode determining part 450. For example, the peak current level of a first driving signal, which drives each of the remaining light-emitting blocks B1, B2, . . . , BJI determined to be in the normal mode, is determined to be at the normal current level (step S145). The peak current level of a second driving signal driving the K-th light-emitting block BK determined to be in the boosting mode is determined to be at the boosting current level, which is higher than the normal current level (step S147). The boosting control part 460 provides the current levels to the signal generating part 470.

For example, the adaptive luminance determining part 461 may determine the adaptive luminance value (Y(Δ)) of the unit image through Equation 5, based on the maximum grayscale value (GMax), the minimum grayscale value (GMin) and the average grayscale value (GAvg). The current control part 463 calculates the boosting current level (Iboost) through Equation 6, based on the adaptive luminance value (Y(Δ)).

The signal generating part 470 generates the driving signals of the light-emitting blocks B1, B2, . . . , BK, . . . , BJI and applies the driving signals to the light-emitting blocks B1, B2, . . . , BK, . . . , BJI. The driving signals have duty ratios based on the dimming levels outputted from the dimming level determining part 420, respectively and have peak currents based on the peak current levels outputted from the boosting control part 460, respectively. Therefore, the light-emitting blocks B1, B2, . . . , BK, . . . , BJI are driven in the boosting mode or the normal mode by the driving signals outputted from the signal generating part 470 (step S150).

Referring to FIGS. 7A and 7B, the signal generating part 470 outputs the second driving signal (shown in FIG. 7A) having the boosting current level (Iboost) to the K-th light-emitting block (BK), and the first signal (shown in FIG. 7B) having the normal current level (Inormal) to the remaining light-emitting blocks B1, B2, . . . , BJI. The first and second driving signals have the maximum duty ratio (DRMAX) corresponding to the full-white light. The duty ratios of the first and second signals are substantially the same as each other with respect to the same dimming level. The peak current level of the second driving signal has the boosting current level (Iboost) and the peak current level of the first driving signal has the normal current level (Inormal). Therefore, the luminance of the K-th light-emitting block (BK) may be higher than the luminance of each of the remaining light-emitting blocks B1, B2, . . . , BJI.

The boosting current level (Iboost) is increased when the size of the bright image included in the unit image is decreased. The luminance value of the unit image may be defined by the bright image size to the power of the luminance characteristics parameter H such as the second curve (Y1(A), Y2(A) or Y3(A)) of the sensitivity display area shown in FIGS. 2A, 2B and 2C.

Figure 8:
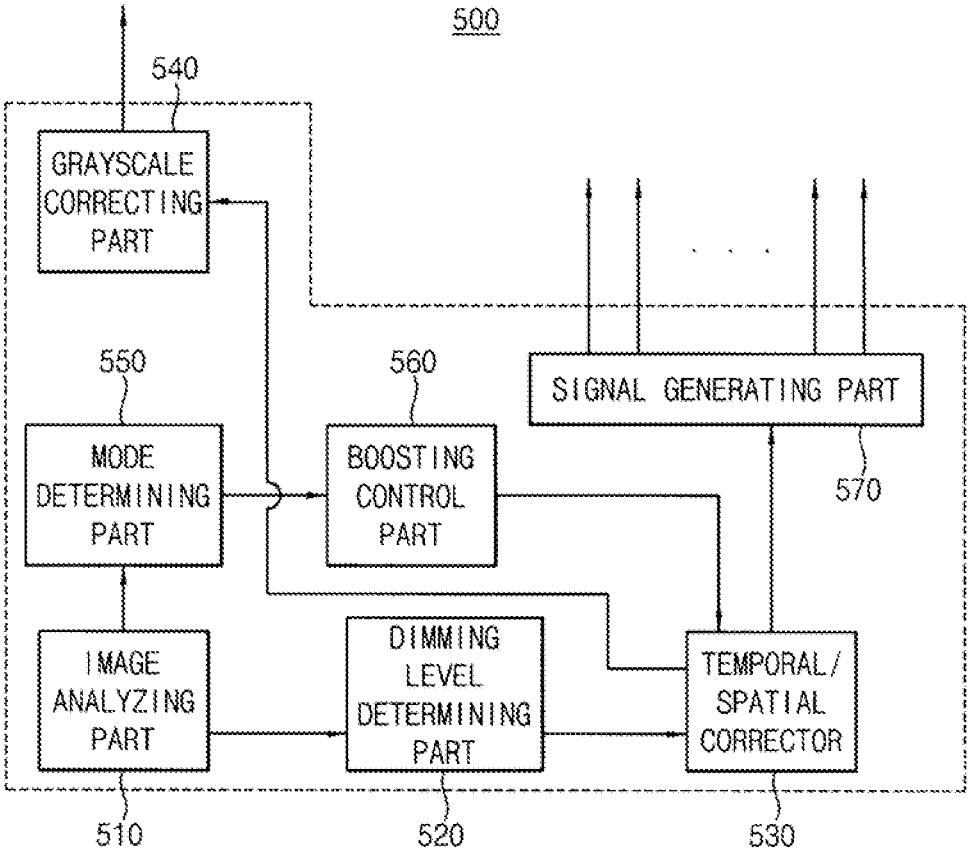
FIG. 8 is a block diagram illustrating a driving part according to another example embodiment of the present invention.

FIG. 8 is a block diagram illustrating a driving part according to another example embodiment of the present invention.

Referring to FIGS. 1 and 8, the dimming part 500 includes an image analyzing part 510, a dimming level determining part 520, a temporal/spatial correcting part 530, a grayscale correcting part 540, a mode determining part 550, a boosting control part 560 and a signal generating part 570.

The image analyzing part 510 divides the pixel data into a plurality of image blocks D respectively corresponding to the light-emitting blocks B and analyzes the grayscale values respectively corresponding to the image blocks D. For example, the image analyzing part 410 obtains a plurality of representative grayscale values respectively corresponding to the image blocks D. Each of the representative grayscale values may be an average grayscale value, a maximum grayscale value, or a selected grayscale value between a maximum grayscale value and a minimum grayscale value. The representative grayscale value may be determined by various formulas.

The dimming level determining part 520 determines a plurality of dimming levels for each of the corresponding light-emitting blocks B based on the representative grayscale values outputted from the image analyzing part 510. Each of the dimming levels controls the luminance of each of the light-emitting blocks B. For example, the dimming level may be determined based upon a duty ratio level of a PWM signal. The dimming level determining part 520 determines a duty ratio level of the light-emitting block based on the representative grayscale value with respect to a normal duty ratio level. The normal duty ratio level corresponds to a duty ratio of a driving signal which drives the light-emitting block B in the full-white state.

The temporal/spatial correcting part 530 corrects the dimming levels so that the corrected dimming levels have smooth temporal and spatial profiles.

The grayscale correcting part 540 corrects the grayscales based on the dimming levels corrected from the dimming level determining part 420. Thus, the transmittance of light transmitted from the pixel of the display panel 100 may be controlled by the corrected grayscale. Therefore, the transmittance is controlled according to luminance of the light-emitting blocks B, which is individually driven, so that power consumption may be reduced and a contrast ratio may be improved.

The mode determining part 550 determines a driving mode of a light-emitting block corresponding to a unit image by comparing a reference value with each of the grayscales corresponding to the unit image. The unit image may be an image corresponding to a single light-emitting block, an image corresponding to grouped light-emitting blocks or a frame image corresponding to all light-emitting blocks of the light source module 300.

For example, the grayscales corresponding to the unit image may include a low grayscale value that is lower than a low reference value and a high grayscale value that is higher than a high reference value. When a ratio of the low grayscale value and the high grayscale value satisfies a boosting condition, the light-emitting block corresponding to the unit image is determined to be in a boosting mode. However, when the ratio of the low grayscale value and the high grayscale value does not satisfy the boosting condition, the light-emitting block corresponding to the unit image is determined to be in a normal mode. For example, a ratio that is used to satisfy the boosting condition may be variously set to values such as (5:1), (10:1), (50:1), (100:1), etc. Generally, the low grayscale value corresponds to a background image and the high grayscale value corresponds to a bright image. When the grayscale value is an 8-bit value, the low reference value may be a grayscale value between about 0 to about 30 and the high reference value may be a grayscale value from about 240 to about 255. The low and high reference values may be variously set.

The boosting control part 560 controls levels of a plurality of driving signals respectively corresponding to the light-emitting blocks B according to the driving mode determined from the mode determining part 550. Each of the levels is a duty ratio level of the driving signal. For example, for a light-emitting block determined to be in the normal mode, the boosting control part 560 sets a duty ratio level of a driving signal to a normal duty ratio level, and, likewise for a light-emitting block determined to be in the boosting mode sets a duty ratio level of a driving signal to a boosting duty ratio level. The boosting duty ratio level is higher than the normal duty ratio level.

The signal generating part 570 generates the driving signals of the light-emitting blocks B using the duty ratio levels corrected from the temporal/spatial correcting part 530 and the set maximum current level. When the driving mode of the light-emitting block is the normal mode, the signal generating part 570 generates a first driving signal using the determined duty ratio level with respect to the normal duty ratio level and the set maximum current level. When the driving mode of the light-emitting block is the boosting mode, the signal generating part 570 generates a second driving signal using the determined duty ratio level with respect to the boosting duty ratio level and the maximum current level. The signal generating part 570 outputs the driving signals to the light-emitting blocks.

Therefore, the peak current levels of the first and second driving signals, that are the maximum current levels, are substantially the same as each other, but the boosting duty ratio level is higher than the normal duty ratio level. Therefore, the luminance of the light-emitting block in the boosting mode may be higher than the luminance of the light-emitting block in the normal mode. Additionally, the duty ratio level of the driving signal is controlled by the size of the bright image included in the unit image, so that the unit image may have the adaptive luminance value with respect to the size of the bright image.

Figure 9:
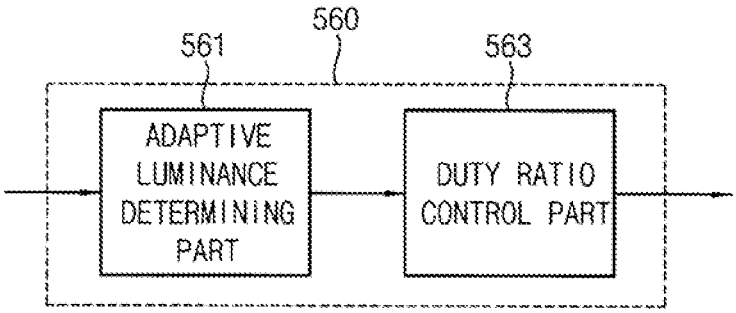
FIG. 9 is a block diagram illustrating the boosting control part of FIG. 8.

FIG. 9 is a block diagram illustrating the boosting control part of FIG. 8.

Referring to FIGS. 8 and 9, the boosting control part 560 includes an adaptive luminance determining part 561 and a duty ratio control part 563.

The adaptive luminance determining part 561 may determine an adaptive luminance value (Y(Δ)) using the grayscale value of the unit image which is used in determining the driving mode, as in Equation 5.

The duty ratio control part 563 calculates the boosting duty ratio level (DRboost) based on the adaptive luminance value (Y(A)). The boosting duty ratio level (DRboost) may be calculated using the following Equation 7 based on Equations 1 to 5.

$$Y_{normal}:\ DR_{normal} = Y(\Delta):\ DR_{boost} \qquad \text{Equation 7}$$

$$DR_{boost} = DR_{normal} \times \left[ \begin{array}{c} 1 - \left(1 - \dfrac{Y_{peak}}{Y_{normal}}\right) \times \\ \left(\dfrac{\Delta}{G_{max} - G_{min}}\right)^{H} \end{array} \right]$$

The normal duty ratio level (DRnormal) is a duty ratio level of the driving signal, which drives the light-emitting block B in the full-white state.

The boosting duty ratio level (DRboost) is increased when the size of the bright image included in the unit image is decreased. The luminance value of the unit image may be defined by the bright image size to the power of the luminance characteristics parameter H such as the second curve (Y1(A), Y2(A) or Y3(A)) of the sensitivity display area shown in FIGS. 2A, 2B and 2C.

The duty ratio control part 563 determines the normal duty ratio level (DRnormal) that is substantially the same as the duty ratio level of the light-emitting block determined from the dimming level determining part 520, when the light-emitting block is in the normal mode. The duty ratio control part 563 determines the duty ratio level of the light-emitting block determined from the dimming level determining part 520 to the boosting duty ratio level (DRboost), when the light-emitting block is in the boosting mode.

Therefore, the duty ratio level of the driving signal is controlled by the size of the bright image included in the unit image, so that the unit image may have the adaptive luminance value with respect to the size of the bright image.

Figure 10:
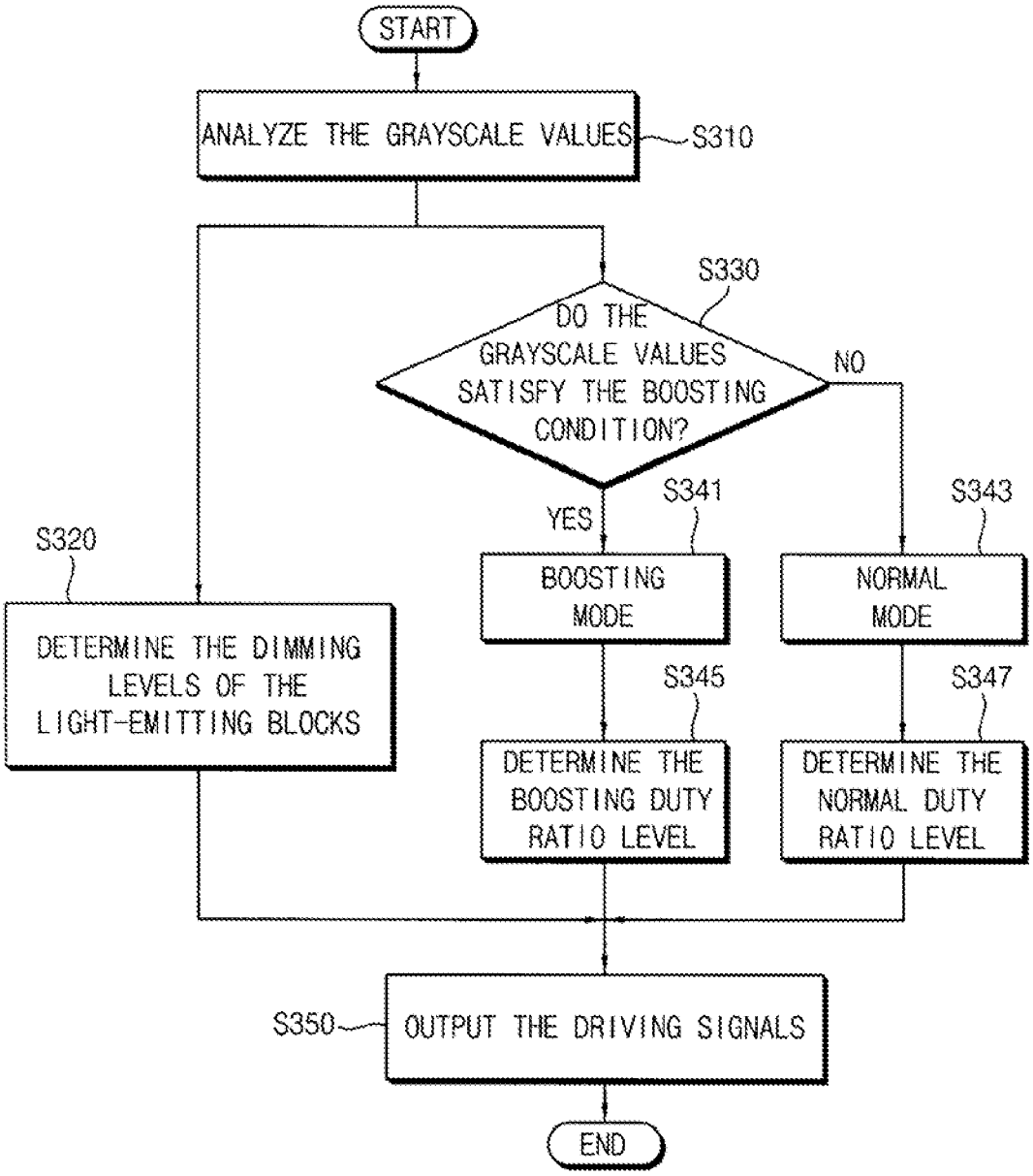
FIG. 10 is a flowchart illustrating a method for driving the driving part of FIG. 8.
Figure 11A:
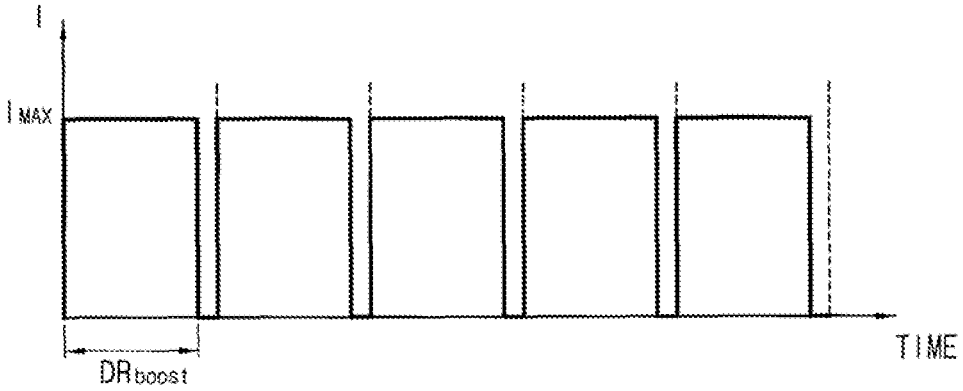
FIGS. 11A and 11B are waveform diagrams showing the driving signals of a boosting mode and a normal mode according to a driving method of FIG. 9.
Figure 11B:
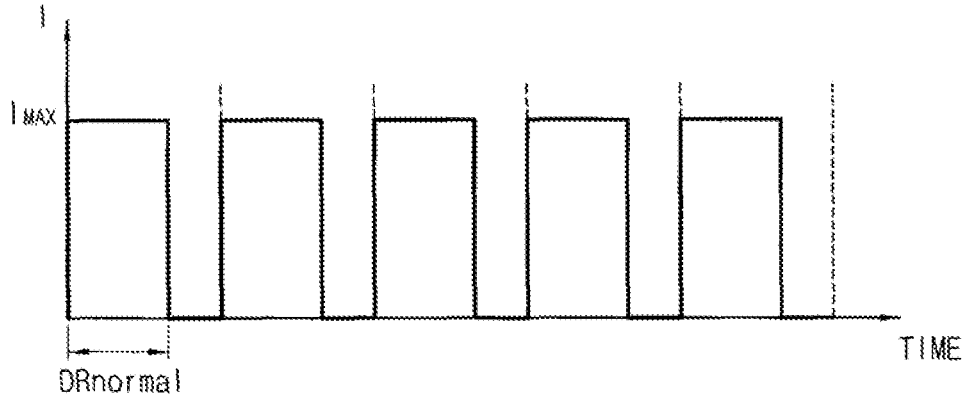

FIG. 10 is a flowchart illustrating a method for driving the driving part of FIG. 8. FIGS. 11A and 11B are waveform diagrams showing the driving signals of a boosting mode and a normal mode according to the method for driving of FIG. 9.

Referring to FIGS. 1 and 10, the image analyzing part 510 divides the pixel data into a plurality of image blocks D respectively corresponding to the light-emitting blocks B and analyzes the grayscale values corresponding to each of the image blocks D (step S310).

The dimming level determining part 520 determines the dimming levels, which are substantially the duty ratio levels of the light-emitting blocks, with respect to the normal duty ratio level based on the representative grayscale values outputted from the image analyzing part 510 (step S320).

The mode determining part 550 uses the grayscale values of the unit image to determine whether the light-emitting block corresponding to the unit image satisfies the boosting condition (step S330). When the grayscale values of the unit image grayscale satisfies the boosting condition, the mode determining part 550 determines the driving mode of the light-emitting block corresponding to the unit image to be the boosting mode (step S341). Therefore, the luminance value of the light-emitting block corresponding to the unit image may be substantially the same as the luminance value of the second (Y1(A), Y2(A) or Y3(A)) of the sensitivity display area shown in FIGS. 2A, 2B and 2C having the luminance value changed according to the size of the bright image included in the unit image.

However, when the grayscale values of the unit image grayscale do not satisfy the boosting condition, the mode determining part 550 determines the driving mode of the light-emitting block corresponding to the unit image to be the normal mode (step S343). Therefore, the luminance value of the light-emitting block corresponding to the unit image may be substantially the same as the luminance value of the first (Y1(G), Y2(G) or Y3(G)) of the grayscale display area shown in FIGS. 2A, 2B and 2C having the luminance value changed according to the grayscale value.

The boosting control part 560 determines the duty ratio level according to the driving mode determined from the mode determining part 550 (step S345). When the light-emitting block is in the normal mode, the duty ratio level of the light-emitting block is determined to be in the normal duty ratio level that is substantially the same as the duty ratio level determined from the dimming level determining part 520 (step S347).

For example, the adaptive luminance determining part 561 may determine the adaptive luminance value (Y(Δ)) of the unit image corresponding to the K-th light-emitting block BK through Equation 5, based on the maximum grayscale value (GMax), the minimum grayscale value (GMin) and the average grayscale value (GAvg). The duty ratio control part 563 calculates the boosting duty ratio level (DRboost) through Equation 7, based on the adaptive luminance value (Y(Δ)). The duty ratio control part 563 determines the duty ratio of the light-emitting block determined to be in the boosting mode, to the boosting duty ratio level (DRboost).

When the driving mode of the light-emitting block is the boosting mode, the signal generating part 570 generates a second driving signal using the determined duty ratio level with respect to the boosting duty ratio level and the maximum current level. When the driving mode of the light-emitting block is the normal mode, the signal generating part 570 generates a first driving signal using the determined duty ratio level with respect to the normal duty ratio level and the maximum current level. The signal generating part 570 outputs the driving signals to the light-emitting blocks (step S350).

Referring to FIGS. 6, 11A and 11B, the signal generating part 570 outputs the second driving signal (shown in FIG. 11A) having the boosting duty ratio level (DRboost) to the K-th light-emitting block (BK) and the first signal (shown in FIG. 11B) having the normal duty ratio level (DRnormal) to the remaining light-emitting blocks B1, B2, . . . , BJI. The peak current level of the first driving signal is the maximum current level (IMAX), and the peak current level of the second driving signal is the maximum current level (IMAX) that is the same as the peak current level of the first driving signal. The second driving signal has the boosting duty ratio level (DRboost) and the first driving signal has the normal duty ratio level (DRnormal) lower than the boosting duty ratio level (DRboost). Therefore, the luminance of the K-th light-emitting block (BK) may be higher than the luminance of each of the remaining light-emitting blocks B1, B2, . . . , BJI.

The boosting duty ratio level (DRboost) is increased when the size of the bright image included in the unit image is decreased. The luminance value of the unit image may be defined by the bright image size to the power of the luminance characteristics parameter H such as the second curve (Y1(A), Y2(A) or Y3(A)) of the sensitivity display area shown in FIGS. 2A, 2B and 2C.

According to the present invention, the level of a driving signal is increased when the size of a bright image included in a unit image is decreased. Therefore, the luminance value of the unit image may be defined by a bright image size to the power of a luminance characteristics parameter H in a sensitivity display area.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method for driving a light source module, the light source module including a plurality of light-emitting blocks, the method comprising:

analyzing a plurality of representative grayscale values corresponding to light-emitting blocks;

determining a driving mode of at least one first light-emitting block based on a size ratio of an image size of at least one second light-emitting block having less than a predetermined low grayscale value to an image size of the at least one first light-emitting block having higher than a predetermined high grayscale value; and applying, based on the size ratio, a first driving signal to the first light-emitting block determined to be operating in a normal mode and a second driving signal to the first light-emitting block determined to be operating in a boosting mode, wherein the first driving signal includes a first duty ratio and a first peak current, and the second driving signal includes a second duty ratio and a second peak current, wherein the first duty ratio corresponds to a normal duty ratio level and is based on a first dimming level, and the second duty ratio corresponds to a boosting duty ratio level and is based on a second dimming level, and wherein the first and second dimming levels control a luminance of the respective light-emitting blocks.

2. The method of claim 1, wherein the boosting mode includes at least one boosting level and the at least one boosting level is increased when the size ratio is increased.

3. The method of claim 2, wherein the predetermined low grayscale value is less than 12% of a maximum grayscale value, and wherein the predetermined high grayscale value is more than 93% of the maximum grayscale value.

4. The method of claim 1, wherein the predetermined low grayscale value is less than 12% of a maximum grayscale value, and wherein the predetermined high grayscale value is more than 93% of the maximum grayscale value.

5. The method of claim 1, wherein the first duty ratio is substantially the same as the second duty ratio, and the second peak current is higher than the first peak current.

6. The method of claim 1, wherein the first peak current is substantially the same as the second peak current, and the second duty ratio is higher than the first duty ratio.

7. A display apparatus comprising:

a light source module including a plurality of light-emitting blocks and configured to emit light; and a driving part configured to:

analyze a plurality of representative grayscale values corresponding to the light-emitting blocks, determining a driving mode of at least one first light-emitting block based on a size ratio of an image size of at least one second light-emitting block having less than a predetermined low grayscale value to an image size of the at least one first light-emitting block having higher than a predetermined high grayscale value, and apply, based on the size ratio, a first driving signal to the first light-emitting block determined to be operating in a normal mode and a second driving signal to the first light-emitting block determined to be operating in a boosting mode, wherein the first driving signal includes a first duty ratio and a first peak current, and the second driving signal includes a second duty ratio and a second peak current, wherein the first duty ratio corresponds to a normal duty ratio level and is based on a first dimming level, and the second duty ratio corresponds to a boosting duty ratio level and is based on a second dimming level, and wherein the first and second dimming levels control a luminance of the respective light-emitting blocks.

8. The display apparatus of claim 7, further comprising:

a display panel comprising a plurality of pixels, wherein the at least one first light-emitting block is configured to provide light to a display area of the display panel in which a pixel having a grayscale value higher than the predetermined high grayscale value is disposed.

9. The display apparatus of claim 8, wherein the boosting mode includes at least one boosting level and the at least one boosting level is increased when the size ratio is increased.

10. The display apparatus of claim 9, wherein the predetermined low grayscale value is less than 12% of a maximum grayscale value, and wherein the predetermined high grayscale value is more than 93% of the maximum grayscale value.

11. The display apparatus of claim 8, wherein the predetermined low grayscale value is less than 12% of a maximum grayscale value, and wherein the predetermined high grayscale value is more than 93% of the maximum grayscale value.

12. The display apparatus of claim 7, wherein the boosting mode includes at least one boosting level and the at least one boosting level is increased when the size ratio is increased.

13. The display apparatus of claim 12, wherein the predetermined low grayscale value is less than 12% of a maximum grayscale value, and wherein the predetermined high grayscale value is more than 93% of the maximum grayscale value.

14. The display apparatus of claim 7, wherein the predetermined low grayscale value is less than 12% of a maximum grayscale value, and wherein the predetermined high grayscale value is more than 93% of the maximum grayscale value.

* * * * *